United States Patent [19]

Fengels

[11] 4,095,769

[45] Jun. 20, 1978

[54] FREIGHT PALLET

[75] Inventor: Gerd Fengels, Hagen, Germany

[73] Assignee: Bruggemann & Brand KG, Wetter (Ruhr), Germany

[21] Appl. No.: 619,001

[22] Filed: Oct. 2, 1975

[30] Foreign Application Priority Data

Feb. 22, 1975 Germany ..... 2507709

[51] Int. Cl.[2] ..... B65D 19/22

[52] U.S. Cl. ..... 248/346; 108/54.1; 108/64

[58] Field of Search ..... 108/51–58, 108/64, 114; 105/366 R; 52/564, 585; 248/346; 403/20, 25, 49, 167, 168, 247, 263, 292, 294, 408; 312/111

[56] References Cited

U.S. PATENT DOCUMENTS

| | | | |
|---|---|---|---|
| 2,599,994 | 6/1952 | Hirsch | 403/292 |
| 3,212,807 | 10/1965 | Luchford et al. | 108/51 X |
| 3,216,376 | 11/1965 | Anderson et al. | 108/56 |
| 3,329,103 | 7/1967 | Cohen | 108/54 |
| 3,437,362 | 4/1969 | Offenbroich | 52/585 X |
| 3,643,603 | 2/1972 | King | 105/366 R |
| 3,703,870 | 11/1972 | Walton | 108/51 X |
| 3,826,206 | 7/1974 | Ruggles | 108/64 |

FOREIGN PATENT DOCUMENTS

| | | | |
|---|---|---|---|
| 1,965,691 | 7/1971 | Germany | 312/111 |
| 947,343 | 1/1964 | United Kingdom | 403/292 |
| 1,375,229 | 11/1974 | United Kingdom | 108/51 |

*Primary Examiner*—Roy D. Frazier
*Assistant Examiner*—William E. Lyddane
*Attorney, Agent, or Firm*—Schuyler, Birch, Swindler, McKie & Beckett

[57] ABSTRACT

An airfreight pallet comprises a core sandwiched between a pair of cover plates with the edges of the core enclosed by a shoulder strip extending around the periphery of the core and extending between the cover plates and forming at least four edges of the pallet, at least one of such pallet edges being provided with a plurality of openings therethrough communicating with internal connecting member holding structures mounted within the core. A plurality of connecting members are provided, one said connecting member being removably insertable into each of such shoulder strip openings and the respective internal connecting member holding structues, and means also are provided for releasably securing the connecting members to the pallet with a portion of each such connecting member projecting outwardly therefrom, whereby a pair of such pallets may be joined together by the insertion and securing of such connecting members into the openings and internal connecting holding structures of respective facing edges of the two pallets.

8 Claims, 8 Drawing Figures

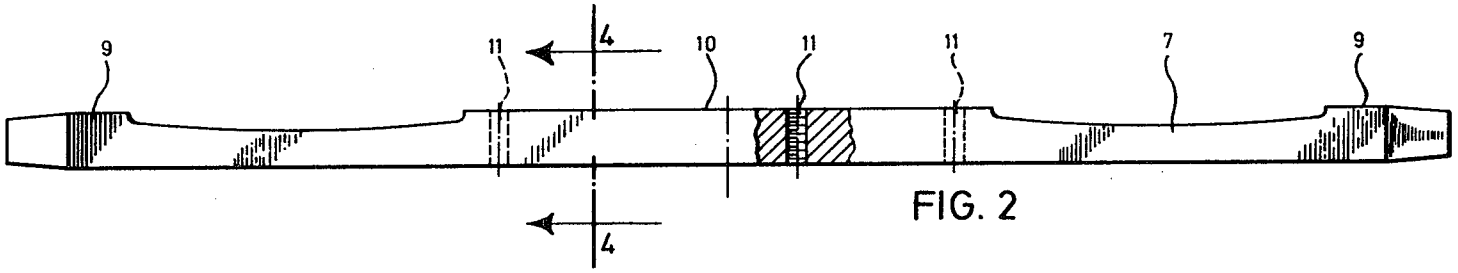
FIG. 2
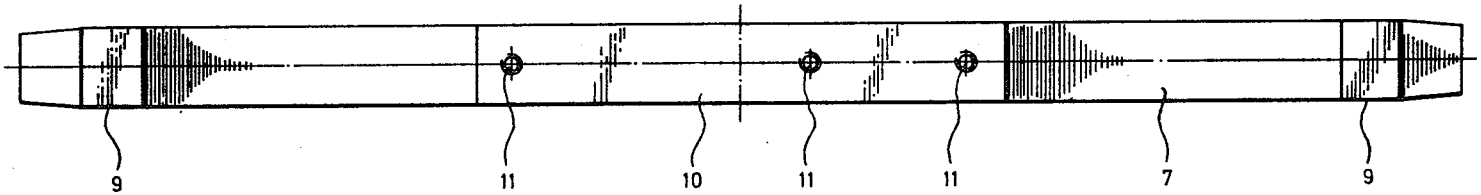
FIG. 3
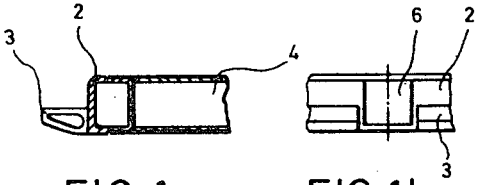
FIG. 1b
FIG. 1a
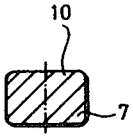
FIG. 4

FREIGHT PALLET

BACKGROUND OF THE INVENTION

The invention relates to a pallet or platform for receiving freight, preferably airfreight for transport by air or for release from airplanes by means of parachutes, the pallet having a light core sandwiched between cover plates and enclosed all around by a shoulder strip.

Pallets of this kind have been known for various air transport systems in several sizes, e.g., 88 × 108 inches for a maximum load of 4 tons or 88 × 54 inches for a maximum load of 2 tons. However, the number of existing sizes is inadequate for providing a satisfactory pallet surface for each load size; thus, the only recourse is to join commercially available sizes securely together so as to obtain fairly large sizes of pallets. In so doing, one encounters considerable difficulties, for the joining area is subject to extraordinary stress occurring particularly when during the loading or unloading of airplane one-half of such a two-part pallet is under stress while in a freely overhanging position, for instance, under one of the aforesaid maximum loads or when considerable forces act upon the platform during the air transport.

In view of the above, it is necessary to use connecting pieces having extremely high load-bearing capacity and therefore requiring bulky as well as loose parts for securely connecting pallets and platforms. Moreover, airfreight pallets frequently exhibit specially shaped shoulder strips adapted to the particular air transport system. By way of example, System 463L of the U.S. Air Forcce requires pallets having a shoulder strip studded all around with spaced-apart connecting flange parts. To obtain a dependable bolted connection for joining pallets of varying sizes it is necessary, for example, to design the connecting flanges in such a manner that they can be unscrewed from the shoulder strip so that the adjacent shoulder strips of two pallets that are to be joined are flush with each other.

The primary object of the invention is to provide a pallet of the kind mentioned at the start of this application, which makes it possible to join pallets in a simple and dependable manner and wherein the kind of connection is usable in a wide range of applications.

SUMMARY OF THE INVENTION

In accordance with the invention, the foregoing and other objects are achieved in that the pallet has on at least one side internal holding structures and connecting pieces that can be inserted in the openings thereof or can be extracted at least partially therefrom, whereby said connecting pieces can be inserted in appropriate openings on the connecting side of another pallet with a view to joining it therewith, said other pallet likewise being provided on the inside with holding structures. The connecting pieces can be secured in their external end positions to both pallets.

According to the above form of construction, the pallet proposed by the present invention is provided on the inside, that is to say, in the core area, with holding structures and is at the same time reinforced so as to form an arrangement in which, as necessary, one can partially extract connecting pieces on the connecting side or sides of the pallet or platform and push the extracted portions into openings of appropriate holding structures on the connecting side of the pallet that are to be connected securely, but removably, to the first-mentioned pallet. In the external end positions, the connecting pieces are secured to both pallets, so that the pallets will take an accurately fixed position in relation to one another, adaptable to the particular requirements, through the selection of suitable safety devices in an appropriate arrangement.

It should be emphasized that the invention makes it possible to join a rectangular pallet or platform selectively to one, more than one, or preferably, to all four sides. Moreover, one can join not only two pallets, but practically any number of loading areas can be fitted together from a multiplicity of pallets in which case, needless to say, the strength requirements must be taken into account.

When not in use, the connecting pieces may, if desired, be left in the pallet. That is to say, they may be pushed entirely into the holding structures to avoid the necessity of storing the single parts. However, the connecting pieces may likewise be stored outside of the pallet or platform and, when in use, be inserted one after the other into the two pallets to be joined.

In all cases, a connection is achieved which has great load-bearing capacity, and which distributes the load normally acting upon the adjacent shoulder strips of the connected pallets over large areas of the neighboring pallets which, to this end, are provided with internal reinforcements made up of the holding structures and the connecting pieces disposed therein. The connecting pieces from a direct bridge between the two reinforced internal areas for the purpose of transmitting and distributing forces which otherwise act upon the edges of the pallets or platforms.

It goes without saying that the manufacturing processes required for the preparation of a pallet for this kind of connection are insignificant when compared with the benefits achievable thereby, and that this kind of connection is characterized in that it can be handled in a simple way without special tools; it needs no maintenance and has a very high load-bearing capacity.

Since the neighboring shoulder strips of connected pallets are not an integral part of the connecting pieces, they can specially be designed for a wide range of applications adaptable to a given air transport or release system. The same holds true for shoulder strips having connecting flange parts used in the U.S. Air Force System referenced hereinabove. A shoulder strip having spaced-apart connecting flange parts offers no obstacles whatever for the kind of connection proposed in this invention, since the connecting pieces can readily be positioned between the connecting flange parts.

The external end position of the connecting pieces within two pallets to be joined can readily be determined such that the prespecified spacing or repetition of the connecting flange parts on the exposed sides of two connected pallets for connecting and locking the pallet is exactly continued even across the space between the two pallets.

The internal holding structures comprise at least one take-up tube spanning the entire width of the pallet and securely connected on both sides to the shoulder strip and at least two second take-up tubes connected on both sides and extending crosswise from the first take-up tube to the shoulder strip, the first and second take-up tubes, which are open in front, forming openings for the connecting pieces. The shoulder strip is provided with openings communicating with the open ends of the take-up tubes.

Thus, the internal holding structures are formed from a load-bearing tube frame which is fitted into the connecting sides of the pallet and securely connected to the shoulder strip. The stress acting on the connecting area can thus be absorbed by the connecting pieces and transmitted to the first and second take-up tubes which, in turn, absorb the load or carry it off to the shoulder strip. Not only the second (short) take-up tubes but also the first (long) take-up tubes serve for receiving connecting pieces, so that all four sides of a pallet or platform may serve for joining other pallets.

The number of first and second take-up tubes is dependent upon the requirements in each case, e.g., maximum load-bearing capacity of the pallet, stresses, etc.

Preferably, tubes with cross-sectional dimensions generally corresponding to the height of the shoulder strip are used for the first and the second take-up tubes. In this way, the existing interior of the pallet is fully utilized for increasing the strength of the internal reinforcement and, on the other hand, the internal holding structures consisting of tubes reinforce the stability of the pallet in the direction of thickness also. Preferably, the cross sections of the first and the second take-up tubes are reduced in height relative to the vertical height of the internal edge of the shoulder strip sufficiently that the cover plates contact the internally lying tubes on both sides and preferably are flush with the top and bottom of the shoulder strip. In this way, optimum construction is achieved with respect to the strength and handling of the pallet.

The internal holding structures are properly secured to the shoulder strip through welded connections, so that permanent and rigid connections are achieved.

As to the form of the extractable and insertable connecting pieces, they preferably have in the center and at both ends a cross-sectional configuration and dimensions corresponding to the internal cross-section of the first and second take-up tubes, as well as reduced cross-section portions, since the important point of contact where the clearance of the connecting pieces within the tube conduits must be small are the areas in the center of the connecting pieces which contact the edges of the openings on the shoulder strips, as well as the ends of the connecting pieces involved to a significant degree in the load transmission.

However, for many applications the connecting pieces may also be made from a tube material, the external cross section of which corresponds to the internal cross section of the first and second take-up tubes.

How far the second (short) take-up tubes are placed from the shoulder strips of the pallet into the interior depends on calculation and the various specifications. However, in order to shift and distribute peak loads from the connecting area into the interior of the pallet, it is convenient to place these tubes a certain distance from the shoulder strip, said distance forming from 1/10 to 1/3 of the pallet width, depending on the size of the pallet.

If the connecting pieces span two pallets to be connected, these must be spaced a certain distance from each other, so that it is necessary to fix a corresponding external end position of the connecting pieces. To achieve this, it is advisable to fix the connecting pieces in the connecting position by means of lock screws that reach through one side of the shoulder strip, preferably from above, and that can be screwed into tapped holes in the connecting pieces. When the connecting pieces are in a nonuse condition, these lock screws can readily be stored by screwing into the connecting piece concerned to avoid any loose single parts.

All pallets or platforms are conveniently equipped with connections for extracting grippers for the purpose of releasing the cargo from an airplane.

The principles of the invention will be more readily understood by reference to the description of the preferred embodiments given hereinbelow in conjunction with the accompanying drawings.

BRIEF DESCRIPTION OF THE DRAWINGS

FIG. 1*a* is a view taken on line 1*a* — 1*a* on FIG. 1.

FIG. 1*b* is a view taken looking in the direction of arrow 1*b* on FIG. 1.

FIG. 2 is a side elevation of one of the connecting members of this invention;

FIG. 3 is a plan view of the connecting member of FIG. 2;

FIG. 4 is a section of the connecting member of FIG. 2, taken along line 4—4;

DESCRIPTION OF AN ILLUSTRATIVE EMBODIMENT

Figure 1:
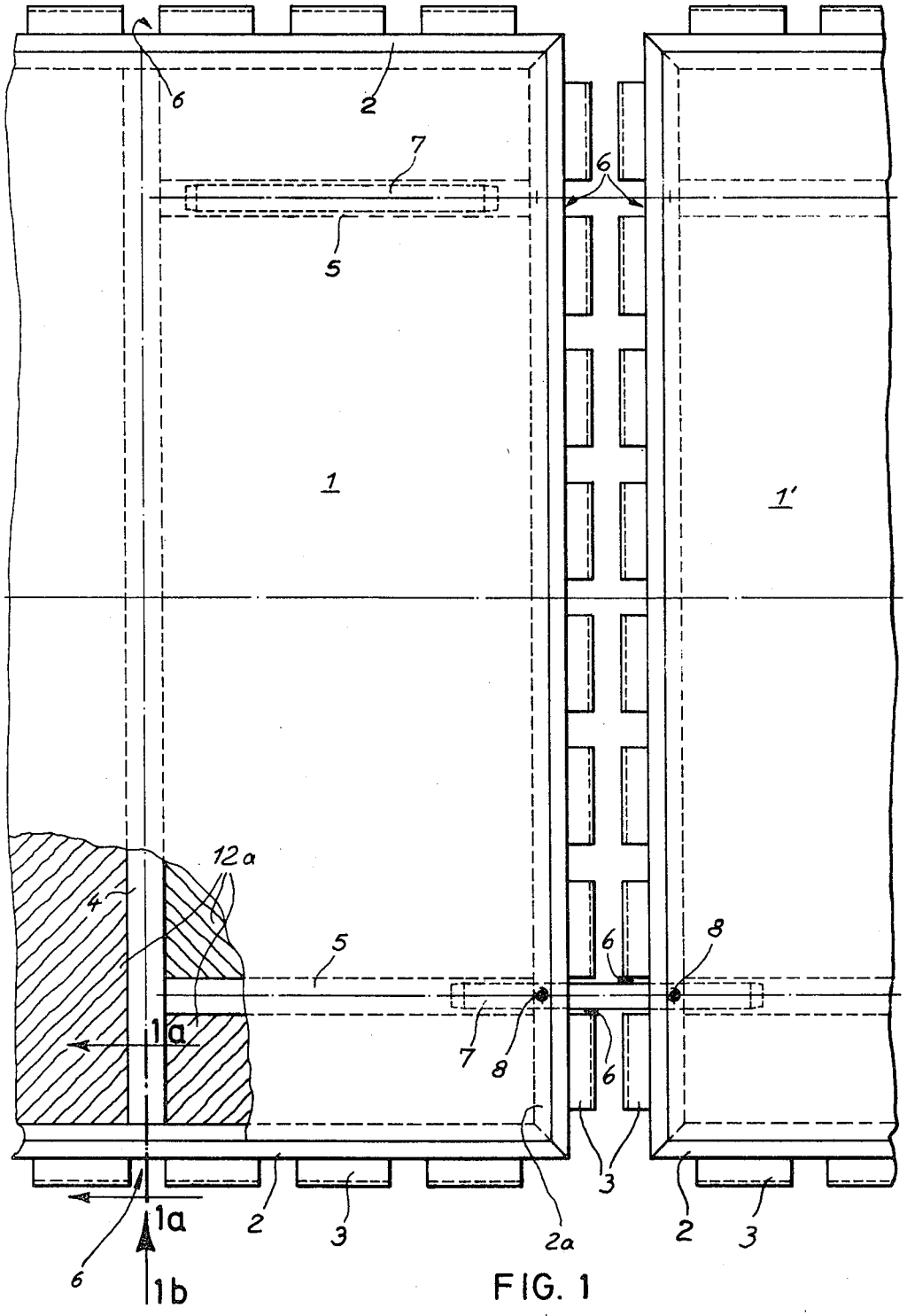
FIG. 1 is a partial plan view of two pallets according to this invention connected together in the manner of this invention.

Of the pallet 1 shown in FIG. 1, only the right half is shown with which the left half is mirror-symmetric, forming a rectangular structure. The shoulder strip 2, extending around the periphery of the core, as identified by reference numeral 12*a* shown on FIGS. 1 and 6, defines the four lateral edges of the pallet and carries spaced-apart connecting flange parts 3, as required in the air-transport and release System 463L of the U.S. Air Force.

At a distance from the shoulder strip portion 2*a*, serving as one of the connecting edges of the shoulder strip 2, there is inserted into the sandwich structure of pallet 1 a long first take-up tube 4 in the manner shown in the drawing and welded at both ends to the shoulder strip 2 on opposing edges of the pallet. From said first take-up tube 4 there extend two short second take-up tubes 5 at right angles to the aforesaid connecting side of pallet 1, which are also welded onto connecting piece 2*a*. As shown clearly in the other figures, the end of the short take-up tubes 5 on the connecting side is open, and appropriate openings substantially flush therewith are cut into the walls of shoulder strip section 2*a*, so that openings 6 are formed affording free passage to the interior of the short take-up tubes 5. The same openings 6 are made on the parts of the shoulder strip 2 extending in a direction transverse to connecting piece 2*a*, where the long take-up tubes 4 run toward the shoulder strip 2. As shown in the drawing, the long take-up tubes 4 and the short take-up tubes 5 are positioned between two of the necessary connecting flange parts 3 in order not to interfere with the usee of such flange parts. Altogether, the welded construction made up of the sections of the shoulder strip 2 involved, the long take-up tubes 4 and the short take-up tubes 5 produce a rigid and load-bearing frame which, at the same time, performs the function of a holding structure, as will be explained hereinbelow.

As shown in the upper part of FIG. 1, an elongated connecting member 7 is inserted in the short take-up tube 5 located thereat and extending conveniently from the rear end of the short take-up tube 5 to the opening 6 in section 2a of the shoulder strip 1. The connecting member (as shown in the lower part of FIG. 1) can, as required, be pulled out easily from the short take-up tube 5 and inserted in an opposite opening 6 of an appropriately positioned similar pallet 1' which is to be connected securely to pallet 1. By means of lock screws 8, extending through shoulder strip portion 2a and into connecting member 7, the connecting member 7, now forming a fixed bridge between the pallets 1 and 1', can be secured in the desired end position, thereby maintaining the necessary spacing or repetition of the connecting flange parts 3 on the exposed sides of the pallets 1 and 1', across the separating gap.

In the same way, the other shoulder strip sections lying above and below with reference to FIG. 1 permit the joining of other pallets through the use of the long take-up tubes 4 and the connecting pieces thereof (not shown) without requiring special explanation.

The locking engagement between the connecting pieces 7 and the short take-up tubes 5 occurs in such a manner that the forces acting upon the connecting area are securely and effectively transmitted to and diverted by the internal reinforcement (made up of the tubular holding structures) formed from the take-up tubes 4 and 5 and the shoulder strip sections involved.

As shown in FIGS. 2, 3 and 4, the connecting piece 7 has a comparatively large cross section at the ends 9, as well as in the center part 10, substantially corresponding to the internal cross section of the take-up tubes 4 and 5, whereas the other sections of the connecting piece 7 are reduced in cross section for better bracing and for material and weight saving. The center part 10 also has tapped holes 11 for receiving the lock screws 8.

Figure 6:
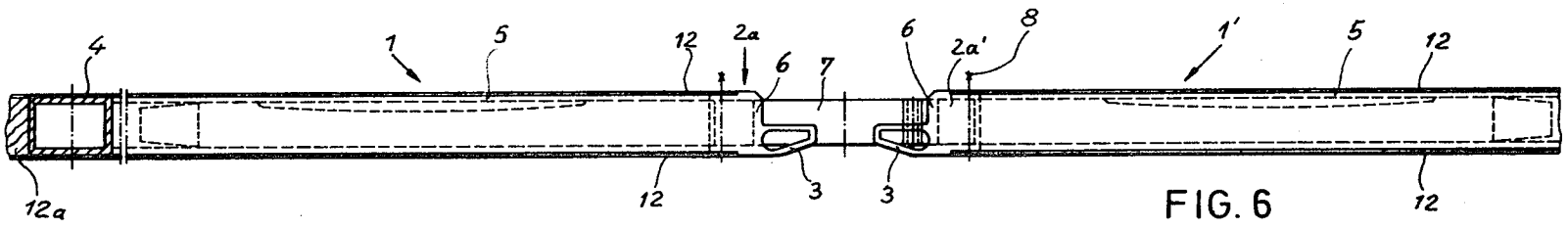
FIG. 6 is a partial side elevation of the two connected pallets of FIG. 5.
Figure 5:
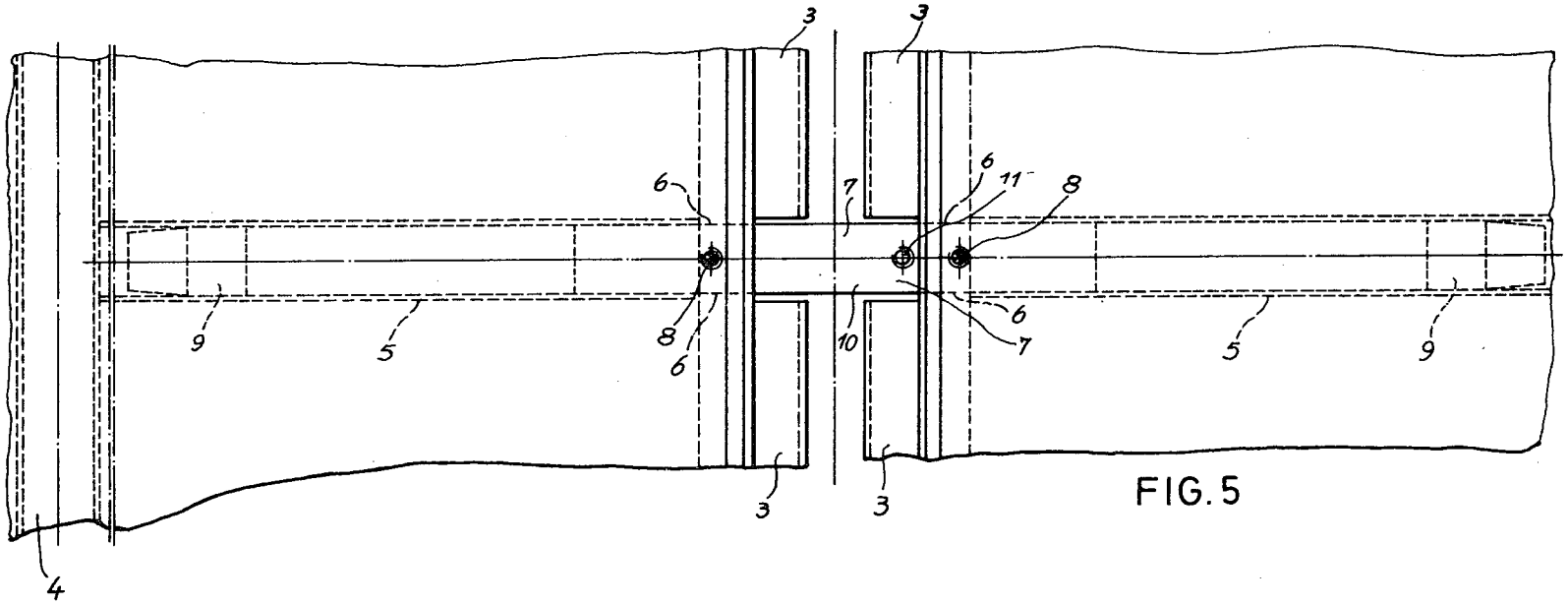
FIG. 5 is a partial plan view of two pallets according to this invention connected by one of the connecting members of this invention.

FIGS. 5 and 6 illustrate on a slightly larger scale the kind of connection of pallet 1 established by the connecting pieces 7 in conjunction with the shot take-up tubes 5. The cross section shown in FIG. 6 indicates how section 2a of shoulder strip 2 is penetrated by the connecting piece 7, which can be pulled out of the shot take-up tube 5 (located behind section 2a and welded onto it) into the operative position, and which can be reinserted when not in use. The position of the load-bearing areas 12 for the cover plates shows that the inner surfaces of the cover plates are in contact with the short take-up tubes 5 or are spaced only a short distance therefrom. The two sections 2a and 2a' of the pallets 1 and 1' to be connected are spaced apart the necessary distance for maintaining the spacing or repetition of the upper and lower (with reference to FIG. 1) row of connecting flange parts 3.

What is claimed is:

1. A pallet for receiving freight such as airfreight for transport by air or for an air drop release from air planes by means of parachutes, comprising:

a laterally extending core;

a pair of cover plates disposed, respectively, above and below said core and sandwiching said core therebetween;

a shoulder strip extending around the periphery of said core and extending between said cover plates, said shoulder strip defining at least four edges of said pallet, at least one said pallet edge being provided with a plurality of openings therethrough;

internal connecting members holding structures mounted within said core between said cover plates and communicating with said pallet edge openings;

a plurality of connecting members, each said connecting member being removably insertable into said shoulder strip openings and said internal connecting member holding structures; and means for releasably securing said connecting members to said pallet with a portion of each connecting member so secured projecting outwardly of said one pallet edge, whereby a pair of such pallets may be substantially rigidly joined together edgewise by insertion and securing of such connecting members into the openings and internal connecting member holding structures of respective facing edges of the two pallets, said pallet being of a rectangular configuration and said internal holding structures comprise at least one first take-up tube extending between and affixed to the shoulder strips defining two pallet edges generally normal to said one said pallet edge, and at least two second take-up tubes, each attached at one end thereof to said first take-up tube and are attached at the opposite end thereof to the shoulder strip defining said one pallet edge, the axially outermost portions, with respect to said pallet, of each said first and second take-up tubes communicating with openings provided in said pallet edge shoulder strips.

2. A pallet according to claim 1 wherein the vertical cross-sectional dimension of said first take-up tube and said second take-up tubes generally corresponds to the height of said shoulder strip.

3. A pallet according to claim 2 wherein said cover plates are inset into the top and bottom of said shoulder strips to render the outer surfaces of said cover plates flush with the top and bottom edges of said shoulder strip, and wherein the vertical cross-sectional dimension of said first take-up tube and said second take-up tubes are reduced in height sufficiently that the inwardly facing surfaces of said cover plates contact two generally opposed sides of said first take-up tube and said second take-up tubes.

4. A pallet according to claim 1 wherein said internal holding structures are welded to said shoulder strip.

5. A pallet according to claim 1 wherein said connecting members comprise elongated members having cross-sectional configuration and dimensions corresponding to the internal cross-sectional configuration and dimensions of said first take-up tube and said second take-up tubes, and said members further include a centrally disposed portion havin a cross section of reduced dimensions.

6. A pallet according to claim 1 wherein said second take-up tubes are placed a predetermined distance, within the range of 1/10 to ⅓ of the width of said pallet, from said shoulder strip, whereby peak loads from the connecting members may be shifted and distributed from said one pallet edge to the interior of the pallet when a pair of such pallets is joined together by such connecting members extending between the respectively opposed said one edge of each such pallet.

7. A pallet according to claim 1 wherein said pallet is of a rectangular configuration and said internal holding structures comprise at least one first take-up tube extending between and affixed to the shoulder strips defining two pallet edges generally normal to said one said pallet edge, and at least two second take-up tubes, each attached at the opposite end thereof to the shoulder strip defining said one pallet edge, the axially outermost portions, with respect to said pallet, of each said first and second take-up tubes communicating with openings provided in said pallet edge shoulder strips.

8. A pallet according to claim 7 wherein the vertical cross-sectional dimension of said first take-up tube and said second take-up tubes generally corresponds to the height of said shoulder strip.

* * * * *